US005938528A

United States Patent [19]

Glapion

[11] Patent Number: 5,938,528

[45] Date of Patent: Aug. 17, 1999

[54] ELECTRONIC DOMINO GAME

[76] Inventor: Andre Glapion, 406 E.57th St., Los Angeles, Calif. 90011

[21] Appl. No.: 08/871,696

[22] Filed: Jun. 9, 1997

[51] Int. Cl.[6] ..... A63F 9/24; A63F 3/00

[52] U.S. Cl. ..... 463/11; 463/46; 273/293; 273/309

[58] Field of Search ..... 463/9, 11, 23, 463/25, 29, 30, 31, 35, 36–38, 46, 47; 273/236, 237, 272, 292, 293, 299, 309, 148 R, 148 B

[56] References Cited

U.S. PATENT DOCUMENTS

| | | | |
|---|---|---|---|
| 3,940,136 | 2/1976 | Runte | 463/46 |
| 4,266,214 | 5/1981 | Peters, Jr. | 364/411.1 |
| 4,530,499 | 7/1985 | Breslow et al. | 463/9 |
| 4,804,185 | 2/1989 | Noble et al. | 463/11 |

FOREIGN PATENT DOCUMENTS

| | | | |
|---|---|---|---|
| 4025337 | 2/1992 | Germany | 273/237 |
| 6304332 | 11/1994 | Japan | 273/309 |
| 2118444 | 11/1983 | United Kingdom | 273/85 G |
| 2235325 | 2/1991 | United Kingdom | 273/237 |
| 2257919 | 1/1993 | United Kingdom | 273/237 |

OTHER PUBLICATIONS

Leisure Genius, "Computer Edition of Monopoly", 15 pages, 1989.

Domino Games, by John Beltonand Joella Cramblit, pp. 1–2, 4–24, 30–41, 1976.

*Primary Examiner*—Jessica J. Harrison
*Assistant Examiner*—Mark A. Sager

[57] ABSTRACT

A electronic domino game including a housing having a top face, a bottom face, and a periphery formed therebetween defining an interior space. An electronic display board is situated on the top face of the housing. The display board is adapted to display thereon a plurality of dominos in a plurality of configurations. A plurality of play stations are situated adjacent an associated edge of the top face of the housing. Each play station includes an elongated rectangular player display situated on the top face of the housing adjacent an associated edge of the display board. The player display is adapted to display a plurality of dominos thereon in linear alignment. Each play station further has a plurality of buttons for allowing play of the game. Lastly, a score display pad is provided having a plurality of digital displays each corresponding to a corresponding play station for displaying a current score of each player.

2 Claims, 3 Drawing Sheets

ELECTRONIC DOMINO GAME

BACKGROUND OF THE INVENTION

1. Field of the Invention

The present invention relates to an electronic domino game and more particularly pertains to allowing the playing of dominos on a portable electronic domino game.

2. Description of the Prior Art

The use of electronic games is known in the prior art. More specifically, electronic games heretofore devised and utilized for the purpose of providing amusement are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,804,185 to Nobel, deceased et al.; U.S. Pat. No. 4,530,499 to Breslow et al.; U.S. Pat. Des. 355,446 to Sahler; U.S. Pat. No. 5,405,151 to Naka et al.; U.S. Pat. No. 5,346,225 to Walling; and U.S. Pat. No. 5,411,270 to Naka et al.

In this respect, the electronic domino game according to the present invention substantially departs from the conventional concepts and designs of the prior art, and in so doing provides an apparatus primarily developed for the purpose of allowing the playing of dominos on a portable electronic domino game.

Therefore, it can be appreciated that there exists a continuing need for a new and improved electronic domino game which can be used for allowing the playing of dominos on a portable electronic domino game. In this regard, the present invention substantially fulfills this need.

SUMMARY OF THE INVENTION

In view of the foregoing disadvantages inherent in the known types of electronic games now present in the prior art, the present invention provides an improved electronic domino game. As such, the general purpose of the present invention, which will be described subsequently in greater detail, is to provide a new and improved electronic domino game which has all the advantages of the prior art and none of the disadvantages.

To attain this, the present invention essentially comprises a housing having a top face, a bottom face, and a periphery formed therebetween defining an interior space. Further included is a liquid crystal display board with a square configuration centrally situated on the top face of the housing. As shown in FIG. 1, the display board is adapted to display thereon a plurality of dominos in a plurality of configurations. Next provided is a plurality of play stations situated adjacent an associated edge of the top face of the housing. Note FIG. 1. Each of such play stations includes an elongated rectangular player liquid crystal display situated on the top face adjacent an associated edge of the liquid crystal display board. The player liquid crystal display is adapted to display a plurality of dominos thereon in linear alignment. Further included as a component of each play station is a cover with a rectangular configuration and a size corresponding to that of the associated player liquid crystal display. Each cover is hingably coupled along a long edge thereof between the liquid crystal display board and the associated player liquid crystal display. By this structure, the covers are adapted to be pivoted between a lowered orientation for covering the associated player liquid crystal display and an upper orientation for displaying the associated player liquid crystal display. A plurality of buttons are provided at each play station. Such buttons include a set of quadrant direction keys, a draw button, a pull button, a pass button, and a play button. Further provided is a score display pad which has a plurality of digital displays each corresponding to an associated play station for displaying a current score of each player. One of foregoing play stations has a pair of score adjustment keys situated within each of the digital displays thereof for manually incrementing and decrementing the score of the player of the corresponding play station. Such play station further has a dealing button for determining the amount of dominos to be displayed on each of the player liquid crystal displays. Lastly, the present play station has a mix button situated adjacent the buttons. Finally, the game includes a sound mechanism situated within the interior space of the housing. Such sound mechanism is adapted to make sounds during play of the game.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electronic domino game which has all the advantages of the prior art electronic games and none of the disadvantages.

It is another object of the present invention to provide a new and improved electronic domino game which may be easily and efficiently manufactured and marketed.

It is a further object of the present invention to provide a new and improved electronic domino game which is of a durable and reliable construction.

An even further object of the present invention is to provide a new and improved electronic domino game which is susceptible of a low cost of manufacture with regard to both materials and labor, and which accordingly is then susceptible of low prices of sale to the consuming public, thereby making such electronic domino game economically available to the buying public.

Still yet another object of the present invention is to provide a new and improved electronic domino game which provides in the apparatuses and methods of the prior art some of the advantages thereof, while simultaneously overcoming some of the disadvantages normally associated therewith.

Still another object of the present invention is to allow the playing of dominos on a portable domino game.

Lastly, it is an object of the present invention to provide a new and improved electronic domino game including a housing having a top face, a bottom face, and a periphery formed therebetween defining an interior space. An electronic display board is situated on the top face of the housing. The display board is adapted to display thereon a plurality of dominos in a plurality of configurations. A plurality of play stations are situated adjacent an associated edge of the top face of the housing. Each play station includes an elongated rectangular player display situated on the top face of the housing adjacent an associated edge of the display board. The player display is adapted to display a plurality of dominos thereon in linear alignment. Each play station further has a plurality of buttons for allowing play of the game. Lastly, a score display pad is provided having a plurality of digital displays each corresponding to a corresponding play station for displaying a current score of each player.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figures 1, 1A:
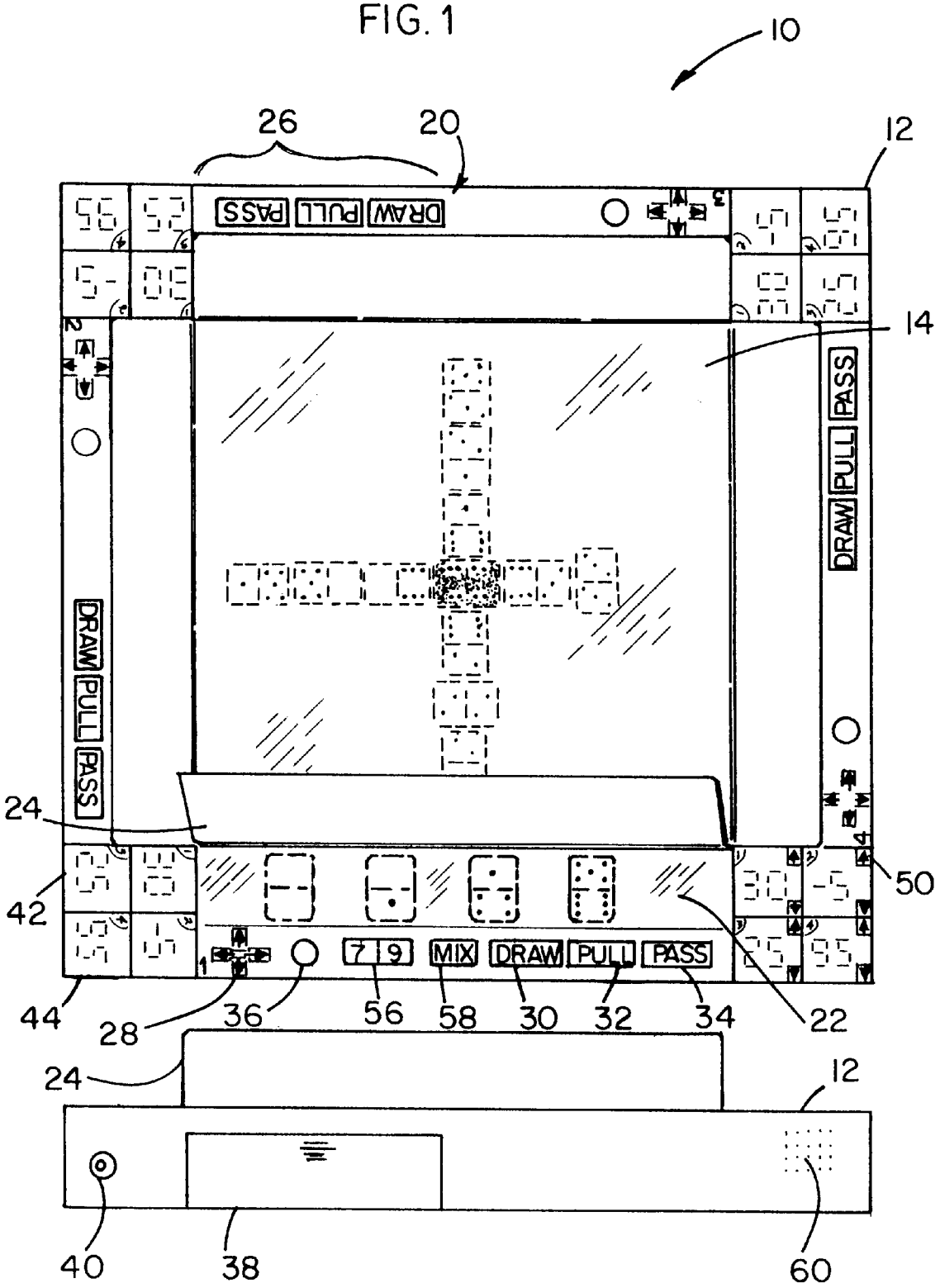
FIG. 1 is an illustration of the preferred embodiment of the electronic domino game constructed in accordance with the principles of the present invention.
FIG. 1*a* is a side elevational view of the housing of the present invention.

With reference now to the drawings, and in particular to FIG. 1 thereof, a new and improved electronic domino game embodying the principles and concepts of the present invention and generally designated by the reference numeral 10 will be described.

The present invention, the new and improved electronic domino game, is comprised of a plurality of components. Such components in their broadest context include a housing, a liquid crystal display board and a plurality of play stations. Such components are individually configured and correlated with respect to each other so as to attain the desired objective.

More specifically, it will be noted that the system 10 of the present invention includes a housing 12 having a top face, a bottom face, and a periphery formed therebetween defining an interior space. Further included is a liquid crystal display board 14 with a square configuration centrally situated on the top face of the housing. As shown in FIG. 1, the display board is adapted to display thereon a plurality of dominos in a plurality of configurations. For reasons that will become apparent later, the display is further adapted to display the dominos in various colors. If necessary, various other types of displays may be utilized for affording such feature if not feasible with liquid crystal display technology, i.e. those utilized in the art of portable computers.

Next provided is a plurality of play stations 20 situated adjacent an associated edge of the top face of the housing. Note FIG. 1. Each of such play stations includes an elongated rectangular player liquid crystal display 22 situated on the top face adjacent an associated edge of the liquid crystal display board. The player liquid crystal display is adapted to display less than 10 dominos thereon in linear alignment. Further included as a component of each play station is a cover 24 with a rectangular configuration and a size corresponding to that of the associated player liquid crystal display. Each cover is hingably coupled along a long edge thereof between the liquid crystal display board and the associated player liquid crystal display. By this structure, the covers are adapted to be pivoted between a lowered orientation for covering the associated player liquid crystal display and an upper orientation for displaying the associated player liquid crystal display.

A plurality of buttons 26 are provided at each play station. Such buttons include a set of quadrant direction keys 28, a draw button 30, a pull button 32, a pass button 34, and a play button 36. Such buttons have a function that is associated with the method of the present invention and accordingly, will be described in greater detail hereinafter. It should be noted that electronic circuitry to accomplish such functions is commonly know in the art of electronic games and will be excluded for purposes of clarity. As shown in FIG. 1*a,* a battery compartment 38 and an AC adapter 40 is included for conventional powering purposes.

Further provided is a score display pad 42 which has a plurality of digital displays 44 each corresponding to an associated play station for displaying a current score of each player. As shown in FIG. 1, the digital displays form a square with each display situated in a unique quadrant with a number printed thereon to identify to which play station it corresponds.

One of foregoing play stations has a pair of score adjustment keys 50 situated adjacent each of the digital displays thereof for manually incrementing and decrementing the score of the player of the corresponding play station. Such play station further has a dealing button 56 for determining the amount of dominos to be displayed on each of the player liquid crystal displays. Lastly, the present play station has a mix button 58 situated adjacent the buttons. It is imperative that only one of the play stations be equipped with the foregoing features for facilitating orderly play.

For reasons that will become apparent later the present invention further includes an unillustrated timer mechanism adapted to track time thereby affording a delay of a predetermined amount.

Finally, the game includes a sound mechanism 60 situated within the interior space of the housing. Such sound mechanism is adapted to make sounds during play of the game. Such sounds include the sound of dominos being mixed and further the sound of a domino being placed on a table.

Figure 2A:
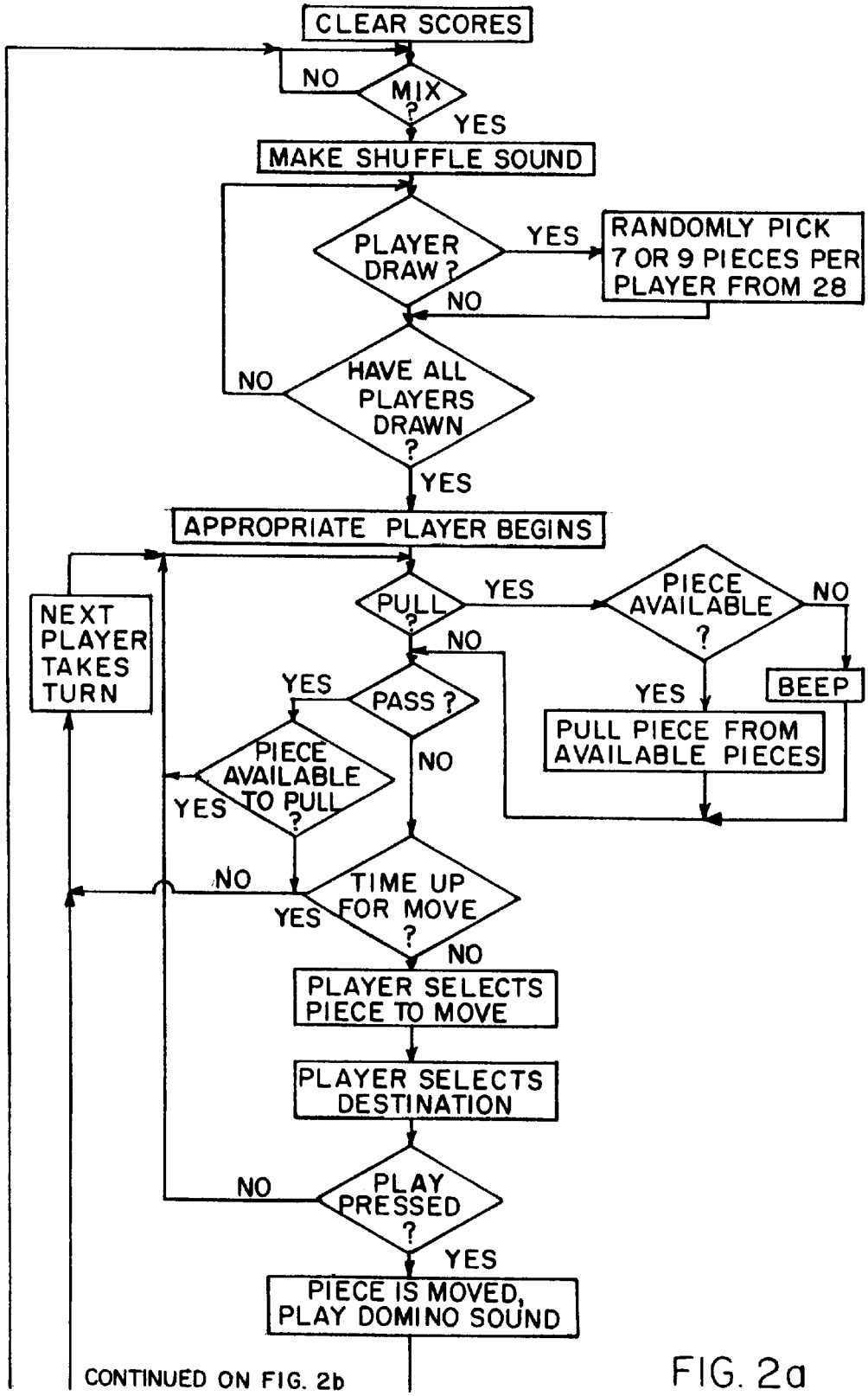
FIG. 2*a* is a flow chart delineating the specific operation of the present invention.
Figure 2B:
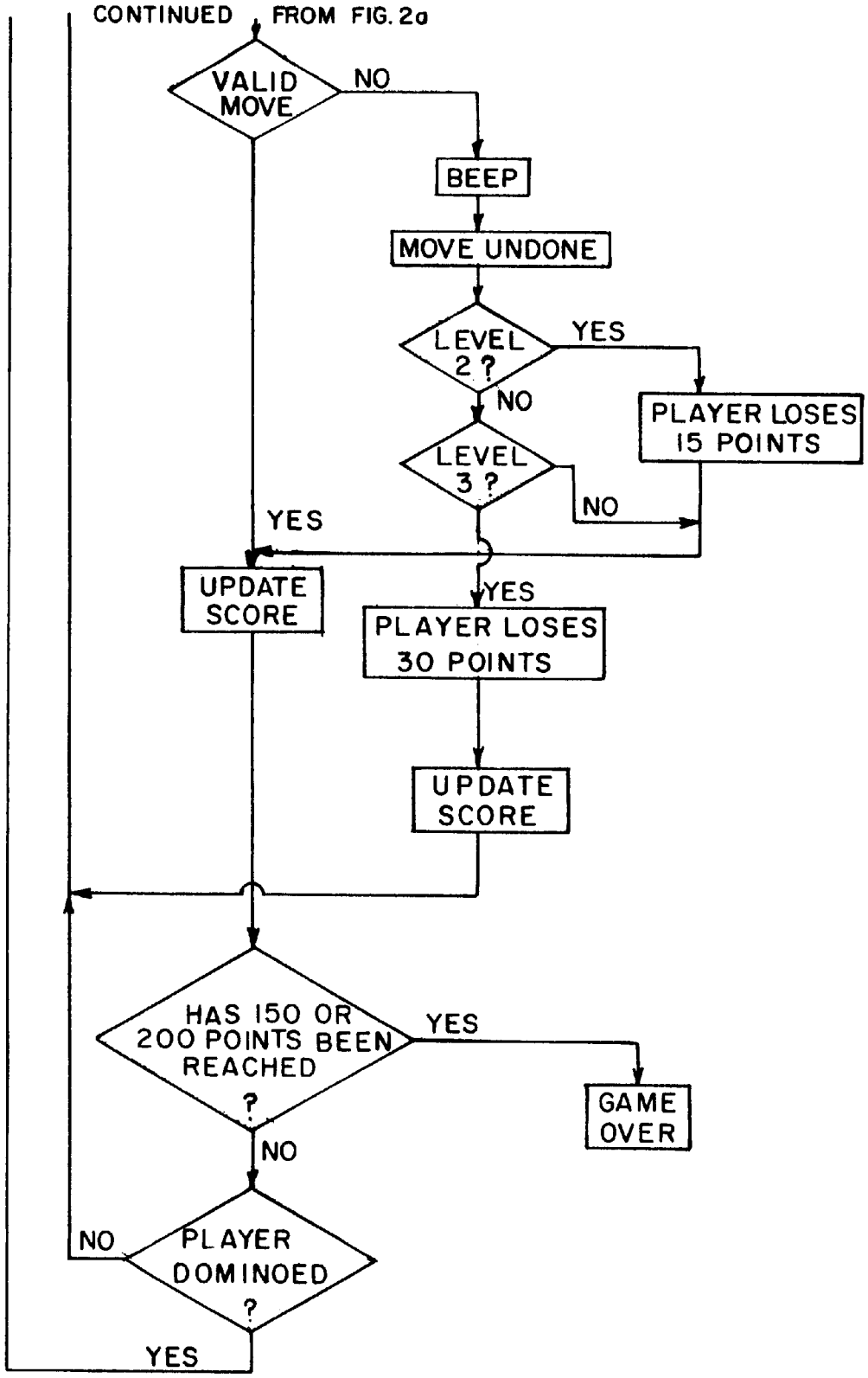
FIG. 2*b* is a continuation of the flow chart of FIG. 2.

The method of play of the present invention will now be described. It should be noted that the description set forth hereinafter is included to disclose only the operation of the various components to afford various capabilities. The object and method of which such capabilities are utilized are in accordance with the conventional game of dominos which is commonly known. The specific flow chart associated with the method of the present invention is shown in FIGS. 2*a* & 2*b*. Such flow chart is further illustrative of the specific programming required of the logic ROM or other control circuitry of the present invention.

Play begins when the mix button is depressed and the display depicts a multiplicity of dominos being shuffled face down. It is the depression of the mix button that prompts the sound mechanism to emit the sound of dominos being shuffled or mixed. Next, each player takes a turn utilizing the toggle button to select a domino whereat the draw button is depressed thereby showing the bottom face and associated value thereof. The player who first draws the domino with a double value is designated as the first player. When such player is determined, the mix button is depressed and the display depicts a multiplicity of dominos being shuffled face down.

Thereafter, the first player and each subsequent player selects 7 or 9 dominos displayed on the player board to be displayed on the player display. Such is accomplished by toggling between the face down dominos and selecting one by means of the draw button. A player may be notified which one of the dominos of the display board is presently selected by depicting it in bold. In the alternative, the dominos may be drawn automatically for each of the players. Whether the players are allowed to pick 7 or 9 dominos is dictated via the dealing button and further governed by the actual number of players playing.

When all of the dominos are selected or drawn, the double value domino that was picked earlier is displayed on the display board in a unique color and the first player and each subsequent player each select via the toggle key one of the dominos that were picked earlier and that are displayed on the player display thereof. When the appropriate domino is selected, the pull button is depressed. Thereafter, the toggle key is utilized to select where on the display board the domino is to be played. When such place is found, the play button is depressed thereby depicting the domino in the designated place on the display board. It should be noted that it is the play button that prompts the sounding of the played domino by the sound mechanism. If a placement of a domino is not possible, the draw button may be utilized to effect the automatic displaying of a new domino on the player display of the current player. After such draw, if the player can still not play, the pass button may be depressed thus signalling to the next player that it is his turn. To allow the discernment of who is the present player, the player displays may optionally be adapted to illuminate or change color to indicate the same.

Scoring is governed by the person whose play station is equipped with the score adjustment keys. After each play the appropriate amount may be added or subtracted from the digital display corresponding to the correct player.

The present invention further has a plurality of levels in which the game may be played. A first level governs play by not requiring the subtraction of points for an illegal play. If such illegal play is attempted, notification is made via a beep or the like and the domino is displayed again in the appropriate player display. The second and third level governs player by requiring the subtraction of 15 and 30 points, respectively, from a player who has placed a domino in an illegal place. The requirement for the subtraction of points may be automatic by means of the circuitry, or in the alternative, be manual. Further associated with the second and third levels are time limits of 1 minute and 30 seconds, respectively. Upon the lapse of the time period prior to the play button being depressed, the turn of the current player is skipped. Again, this can be accomplished either automatically or manually. In addition, while playing on the third level, the player who plays an illegal play loses his present turn. In an additional mode of operation, a single player may play alone with the circuitry of the present invention governing the plays against him in a manner similar to many chess games. To initiate any of the above modes of operation, a plurality of unillustrated buttons may be included.

As in the traditional game of dominos, a winner is declared as either the person who runs out of dominos displayed on the player thereof or the person having the most points when no more plays are possible.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electronic domino game comprising, in combination:

a housing having a top face, a bottom face, and a periphery formed therebetween defining an interior space;

a liquid crystal display board with a square configuration centrally situated on the top face of the housing, the display board adapted to display thereon a plurality of dominos in a plurality of configurations;

a plurality of play stations situated adjacent an associated edge of the top face of the housing, each play station comprising:

an elongated rectangular player liquid crystal display situated on the top face adjacent an associated edge of the liquid crystal display board, the player liquid crystal display adapted to display a plurality of dominos thereon in linear alignment, a cover with a rectangular configuration and a size corresponding to that of the associated player liquid crystal display, the cover having a long edge and a hinge coupling the long edge to a location on the play station between the liquid crystal display board and the associated player liquid crystal display for movement of the cover between a lowered orientation for covering the associated player liquid crystal display and an upper orientation for displaying the associated player liquid crystal display, a plurality of buttons including a set of quadrant direction keys, a draw button, a pull button, a pass button, and a play button, and a score display pad having a plurality of digital displays each corresponding to a corresponding play station for displaying a current score of each player;

one of said play stations having a pair of score adjustment keys situated within each of the digital displays for manually incrementing and decrementing the score of the player of the corresponding play station, a dealing button for determining the amount of dominos to be displayed on each of the player liquid crystal displays and a mix button situated adjacent the buttons; and a sound mechanism situated within the interior space of the housing and adapted to make sounds during play of the game.

2. An electronic domino game comprising:

a housing having a top face, a bottom face, and a periphery formed therebetween defining an interior space;

an electronic display board situated on the top face of the housing, the display board adapted to display thereon a plurality of dominos in a plurality of configurations;

a plurality of play stations situated adjacent an associated edge of the top face of the housing, each play station comprising:

an elongated rectangular electronic player display situated on the top face adjacent an associated edge of the display board, the player display adapted to display a plurality of dominos thereon in linear alignment, and a plurality of buttons for allowing play of the game; and an electronic score display pad having a plurality of digital displays each corresponding to a corresponding play station for displaying a current score of each player, each of the play stations including a cover with a rectangular configuration and a size corresponding to that of the associated player display, the cover having a long edge and a hinge coupling the long edge to a location on the play station between the liquid crystal display board and the associated player liquid crystal display for movement of the cover between a lowered orientation for covering the associated player liquid crystal display and an upper orientation for displaying the associated player liquid crystal display.

* * * * *